United States Patent [19]

Kief

[11] Patent Number: 4,854,255

[45] Date of Patent: Aug. 8, 1989

[54] SAILING PROVISIONS INCLUDING RELEASE TO PREVENT CAPSIZING

[76] Inventor: Horst Kief, Londoner Ring 105, D-6700 Ludwigshafen, Fed. Rep. of Germany

[21] Appl. No.: 125,387

[22] Filed: Nov. 25, 1987

Related U.S. Application Data

[63] Continuation-in-part of Ser. No. 828,138, Feb. 10, 1986, abandoned, which is a continuation-in-part of Ser. No. 571,468, Jan. 17, 1984, abandoned.

[30] Foreign Application Priority Data

Jan. 18, 1983 [DE] Fed. Rep. of Germany ... 8301133[U]

[51] Int. Cl.[4] ..... B63H 9/04

[52] U.S. Cl. ..... 114/39.1; 114/103

[58] Field of Search ..... 114/39.1, 89–109, 114/111–115, 125

[56] References Cited

U.S. PATENT DOCUMENTS

| | | | |
|---|---|---|---|
| 182,288 | 9/1884 | Ray | 114/217 |
| 361,102 | 4/1987 | Wheeden | 114/103 |
| 689,648 | 12/1901 | Lowry | 114/103 |
| 1,504,057 | 8/1924 | Koelkebeck | 114/103 |
| 1,516,063 | 11/1924 | Scammell | 114/103 |
| 2,435,447 | 2/1948 | Kortum | 114/199 |
| 3,053,219 | 9/1962 | Coon | 114/103 |
| 3,403,653 | 10/1968 | Bush | 114/103 |
| 4,453,483 | 6/1984 | Shallenberger | 114/102 |
| 4,501,215 | 2/1985 | Hart et al. | 114/91 |

*Primary Examiner*—Sherman D. Basinger
*Assistant Examiner*—Stephen P. Avila
*Attorney, Agent, or Firm*—Horst M. Kasper

[57] ABSTRACT

A sailing provision includes a multiprofile sail with a plurality of individual profiles, which overlap each other and which are variable in their distance from each other. The multiprofile sail replaces conventional one piece head sails or main sails. The multiprofile sails can be trimmed via a special rope construction and can be tensioned in windward or leeward direction. Since the individual profiles can be rotated rapidly around their axis near the luff of the sail, the system offers a capsizing security independent of tensioning in windward or lee direction and/or independent of the heeling angle.

24 Claims, 10 Drawing Sheets

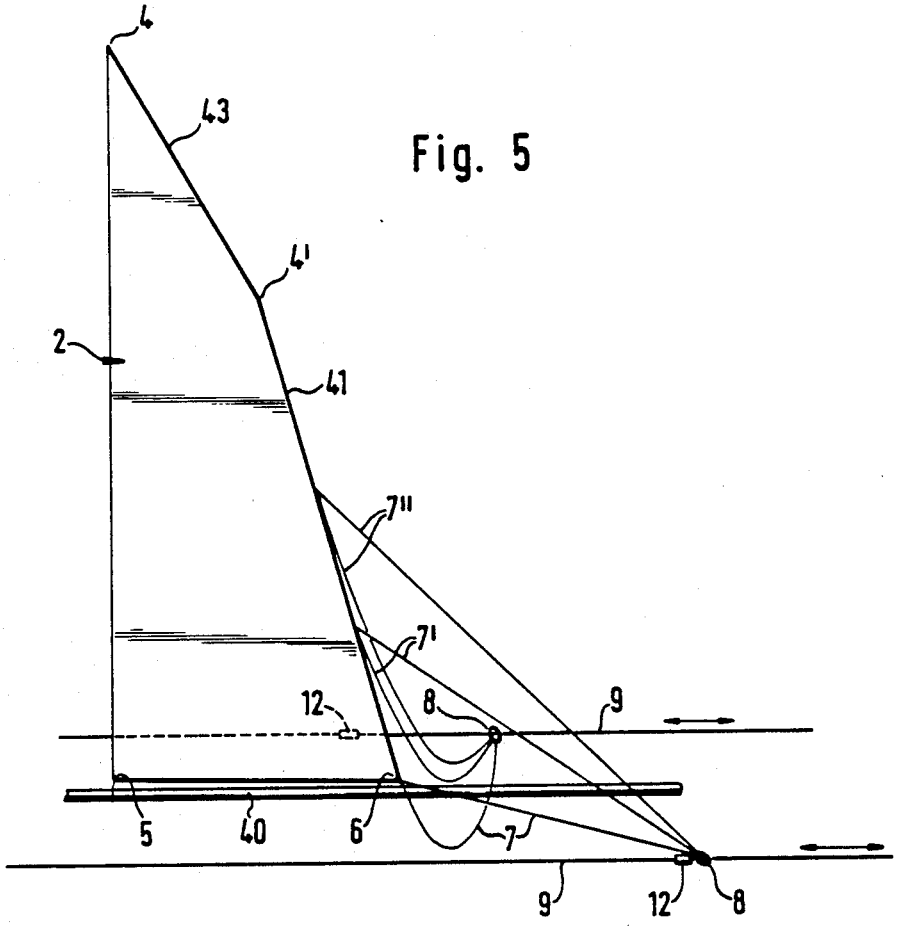
Fig. 5
Fig. 10
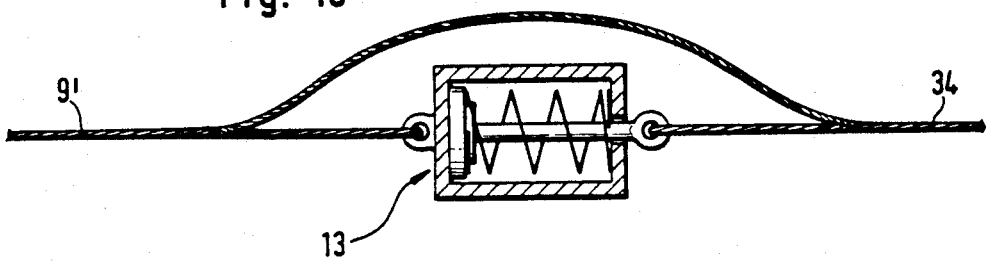

SAILING PROVISIONS INCLUDING RELEASE TO PREVENT CAPSIZING

CROSS-REFERENCE TO RELATED APPLICATIONS

This application is a continuation-in-part application of another application filed Feb. 10, 1986 and bearing Ser. No. 828,138 now abandoned. This application Ser. No. 828,138 in turn is a continuation-in-part application of another application filed Jan. 17, 1984 and bearing Ser. No. 571,468 now abandoned. The entire disclosure of these latter applications, including the drawings thereof, is hereby incorporated in this application as if fully set forth herein.

BACKGROUND OF THE INVENTION

1. Field of the Invention

The present invention relates to the production of sailing vessels with effective sail disposition and with mechanisms for manipulating and releasing the sail from the driving position.

2. Brief Description of the Background of the Invention Including Prior Art

In principle, the same driving forces act on a sail of a boat as are acting on a vertically disposed aircraft wing. The thrust distribution at the sail is composed of the overpressure on the windward side and of the underpressure on the leeside and is determined by the physical laws of buoyancy forces for aerodynamic buoyancy, that is in case of a subsonic advancing flow the resulting thrust forces on the suction side and on the pressure side are in a relationship of about two to one.

In order to improve the conditions of the employment of sails the following requirements are considered to achieve optimal action by a sail based on experiences and rules observed in the past.

The advance flow speed on the backside of the sail should be increased in order to increase the underpressure to a maximum value based on particular technical provisions.

Further, the ratio of the height of the sail to the area of the sail should be favored with respect to the height of the sail as far as possible in order to achieve a high effectiveness, since the buoyancy of a wing profile is basically determined by the aspect ratio (=span width squared divided by the wing area). The requirement of an optimum wing extension or in other words of an optimum height of the sail has naturally set limits given by technical and construction considerations, since an extremely high sail would represent a correspondingly strong heeling torque for the hull of a boat. These requirements are not or only insufficiently met by conventional sailing vessel constructions, for example in case of a far extending foresail (Genova), in order to feed the advancing wind to the rear of the main sail. Or, in case of larger vessels several foresails are employed, this however is associated with additional rope work and therefore does not permit rapid sailing maneuvers and in addition creates a tendency of the boat to move to the windward side and is restricted to larger boats due to the space requirements. In addition, new constructions based on using a stronger thrust via the sail rear face by providing slots in the sails have not become commonplace due to the relatively poor guiding of the air flow on the rear face of the sail and the poor efficiency while sailing before the wind according to this method, since the efficiency is decreased corresponding to the necessary pressure loss on the windward side caused by the slots. In addition, the attempt to dispose sail flaps behind the slots in order to achieve a kind of nozzle effect failed to be a breakthrough, since this solution is associated with the following disadvantages:

1. This solution employs only part of the circulation on the windward side of the sail face.
2. The optimum uniform flow course on the upper side or on the leeside of the profile is disturbed by vortex formation at the flaps.
3. If the flaps are employed only on one side, then they are effective only with regard to certain directions of wind and vessel.
4. If the flaps are employed on both sides, then the flow course of the windward side profile is additionally disturbed by the fluttering flaps and the problem of vortex formation as set forth above under 2 is of increased importance.

A related state of the art is described in the U.S. Pat. No. 689,648 (Lowry). Lowry teaches slotted sails in such a way as to result in individual profiles which overlap each other in part in the longitudinal direction of the boat, where this holds both for the main sail as well as for the head sail. The use of this sail is effective as long as the wind remains constant, that is, a wind where the flow direction and the flow speed do not change relative to the boat or, respectively, its sails. In addition, the direction of the boat or ship has to be maintained constant.

If the direction of the ship is no longer constant and this becomes extreme upon a turning of the boat, that is, upon a change in direction, then the flow direction changes to the other side of the boat. The windward and the leeward directions are exchanged and the individual profiles have to be stretched or, respectively, varied via the foot rope corresponding in each case. This is performed in a conventional way, that is, via in each case individual steering ropes which are coordinated to the individual segments of the sail and which thus can only be operated individually and are correspondingly attached at a corresponding large number of points. In case of a required change in the sail, that is, in case of one of the maneuvers recited above, each steering line has to be individually released, the individual profile has to be individually steered and/or varied or, in case of a simultaneous operation, a rope and cable mess has to be expected. This means that the steering ropes and cables entangle and there eventually occurs separate guiding of the individual profiles of the sail. Even if no entanglement occurs, each individual control line has to be individually again attached. In addition, the control ropes have to be handled such that the rear parts or afterleeches of a forward individual profile have to be passed at the front part of the luffs of the individual profiles disposed behind. Thus these individual profiles have to be passed without being entangled. This means that the rear parts have been guided around the respective warping point in each case.

If this results in delays during actual maneuvering, for example because of the entanglement, then the danger of capsizing is naturally very large. Just because of this problem, but also because of the rope entanglement, this conventional proposal has not had much success. This can be understood since for nearly every individual profile a special operation would be required.

SUMMARY OF THE INVENTION

1. Purposes of the Invention

It is an object of the present invention to provide a sail construction which avoids the problems associated with the effectiveness of conventional sails.

It is an object of the present invention to provide a steering system for sails which furnishes a quick and problem-free maneuvering capability and eliminates any requirement to add additional personnel on the boat and at the same time results in an optimum use of the wind forces similar to the use with airplanes and which allows for adjusting the profiles of the sail in absolutely flow-congruent settings.

It is an additional object of the invention to eliminate as far as possible a danger of rope entanglement and mess and to provide a safety against capsizing at least as large as that of conventional sailboats which are not provided with an improvement with respect to the use of the wind energy. The safety against capsizing should also be dependent on heeling and/or wind pressures.

It is another object of the present invention to provide a sail which allows rapid changes in its position relative to the vessel to be performed.

It is a further object of the present invention to provide a sail construction which provides safety releases of the ropes in case of a danger of capsizing.

It is also an object of the present invention to provide a steering system for sails which furnishes a quick and problem-free maneuvering capability and eliminates any requirement to add additional personnel on the boat and at the same time results in an optimum use of the wind forces similar to the use with airplanes and which allows for adjusting the profiles of the sail in absolutely flow-congruent settings.

It is an additional object of the invention to eliminate as far as possible a danger of rope entanglement and mess and to provide a safety against capsizing at least as large as that of conventional sailboats which are not provided with an improvement with respect to the use of the wind energy and where the safety against capsizing is dependent on heeling and/or wind pressures.

These and other objects and advantages of the present invention will become evident from the description which follows.

2. Brief Description of the Invention

The present invention provides a sailing provision which comprises a multiprofile sail including a plurality of individual profiles, which overlap each other as projected in a side direction of the vessel and which are variable in their distance from each other. An individual profile is a sheet of material adapted to receive a driving force exerted by a wind stream. A multiprofile sail is a sail construction involving more than one profile, where the profiles are linked to each other.

The individual profiles can be pulled windward or leeward with ropes disposed on the stern side independent of the total position of the sails. The ropes can be provided with rings where the rings are guided freely slidable by a surrounding rope. Linking ropes are linked to the individual profiles and disposed toward the stern side of the vessel independent of the overall position of the sails formed by the profiles. A surrounding rope runs about the outside of the vessel and is connected to the linking ropes. The surrounding rope preferably comprises stops for a sheet line of the sail and where the stops can pull or trim the individual profiles astern to both sides as desired via free sliding rings. Linking ropes are linked to the individual profiles and disposed toward the stern side of the vessel independent of the overall position of the sails formed by the profiles. A surrounding rope runs about the outside of the vessel and is connected to the linking ropes.

Parts of the sheets can be provided of an elastic material of limited extension such that the profiles can open up based on the wind pressure and depending on the load. The luff of the individual profiles can be trimmed with ropes disposed at the bow side. The ropes can be automatically tightened based on the stops and the rings upon actuation of the main sheet line of the sail by a counter motion of the surrounding rope on the opposite side.

A trimming provision of the luff of the sail preferably engages leeward at a point behind the luff of the sail at the sail batten in order to trim the individual profile. The sail battens can be of differing elasticity along their length. The maximum of elasticity can be located at the hingepoint of the trimming provision of the luff of the sail. The sheet lines of the foresail and of the main sail are combined to a joint rope in order to allow trimming of the profiles of the foresail and the main sail at the same time.

A front roller can be employed for redirecting the surrounding rope, where two ropes are provided for each individual profile with one rope connected to a first branch side of the surrounding rope and with a second one rope connected to a second branch side of the surrounding rope. Thus pulling on one side of the surrounding rope results in a trimming of the ropes associated with that side and is accompanied by a loosening of the ropes associated with the other side. Two rollers can be disposed astern each for rolling up a respective end of the surrounding rope and thereby controlling the positioning of the profiles. Alternatively, the surrounding rope can form an endless loop. A rear roller can support the endless loop of surrounding rope at the rear side.

A heeling angle dependent securing provision can be furnished for releasing the sheet line in case of a danger of capsizing or overturning. The heel dependent securing provision against capsizing can comprise a hinge held together based on a ring pressure spring through which a rope is led, which rope is released upon opening of the hinge. The sheet line of the large sail can run through the hinge. A pendulum can be provided having a short and a long arm. The two halves of the hinge can be pressed apart by the short arm of a pendulum upon heeling of the boat to any side, where the short arm of the pendulum is kept in a constant vertical position by a pendulum weight. Set screws and cover plates can be provided, which are adjustable in their distance to the short arm of the pendulum such that the release angle can be separately adjusted for the two sides. The securing rope after release by the hinge can be fixed again behind the hinge in starting position based on a reset spring upon decrease of the wind pressure.

The rings on the rope can be guided freely slidable along a certain length over one part of a two part rope section of the rope.

There is further provided a method to sail a vessel which comprises constructing a sail as a multiple profile sail with overlapping individual profiles, which can be varied in their relative distance, pulling the individual profiles windward or leeward with stern located ropes independently of the total sail position and guiding the ropes with rings attached to their ends, which rings slide freely over a surrounding rope.

The individual profiles can be pulled and trimmed astern to a selected side via the freely sliding rings based on stops incorporated into the surrounding rope, the sheet line of the foresail and the sheet line of the main sail. An opening of the profiles means that the profiles are turned in such direction that the overlap of the profiles relative to an oncoming wind decreases. The opening of the profiles can be allowed depending on the load based on the wind pressure by employing parts of the sheet lines made of elastic material of limited extension. The vessel can be secured against capsizing by running a sheet line through a hinge kept closed with a ring compression spring, and by releasing the sheet line by opening of the hinge. A pendulum mounted on the vessel can be maintained in a vertical position with a pendulum weight, the two halves of the hinge can be separated upon heeling of the vessel to any side with the short arm of the pendulum, the release angle of the vessel with regard to overturning can be set for a desired side with set screws and pressure plates, which can be adjusted in their relative position to the short arm of the pendulum.

These features provide the advantageous properties looked for. The sail in each case is replaced by a provision where several individual profiles connected to each other are employed, which profiles are optimized as to their relations of span width to the area of the wing and which overlap each other in a certain ratio to each other.

In addition, the new sail provision based on its rope system allows not only an absolute flow congruent position of the individual profiles with respect to the wind, but in addition a rapid handling is provided like that hitherto known only of a single foresail or main sail.

In addition, the novel sail provision comprises a safety provision against capsizing of the boat depending on wind pressure or heeling angle if parts of the rope system are provided from elastic materials, since the individual profiles can be rotated around the longitudinal axis at the front attachment point due to the short distance, in contrast to a total foresail or a large main sail, whose rotation point is represented by the luff of the sail or by the boom.

The individual sailing faces can be profiled afterward with a minimum expenditure in view of an optimum aerodynamic behavior during the ride.

The multi-profile sail with safety provision against heeling provides the advantage of working with conventional material (in contrast to the rigid sailing) and of allowing a retrofitting of boats without large expenditures because of its relatively simple construction.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 5 is a schematic side view of the middle individual profile of the main boat sail of FIG. 1 with its rigging, FIG. 10 is a schematic detailed view of an elastic intermediate piece of the sheets of FIGS. 6–9.

DESCRIPTION OF INVENTION AND PREFERRED EMBODIMENTS

Figure 1:
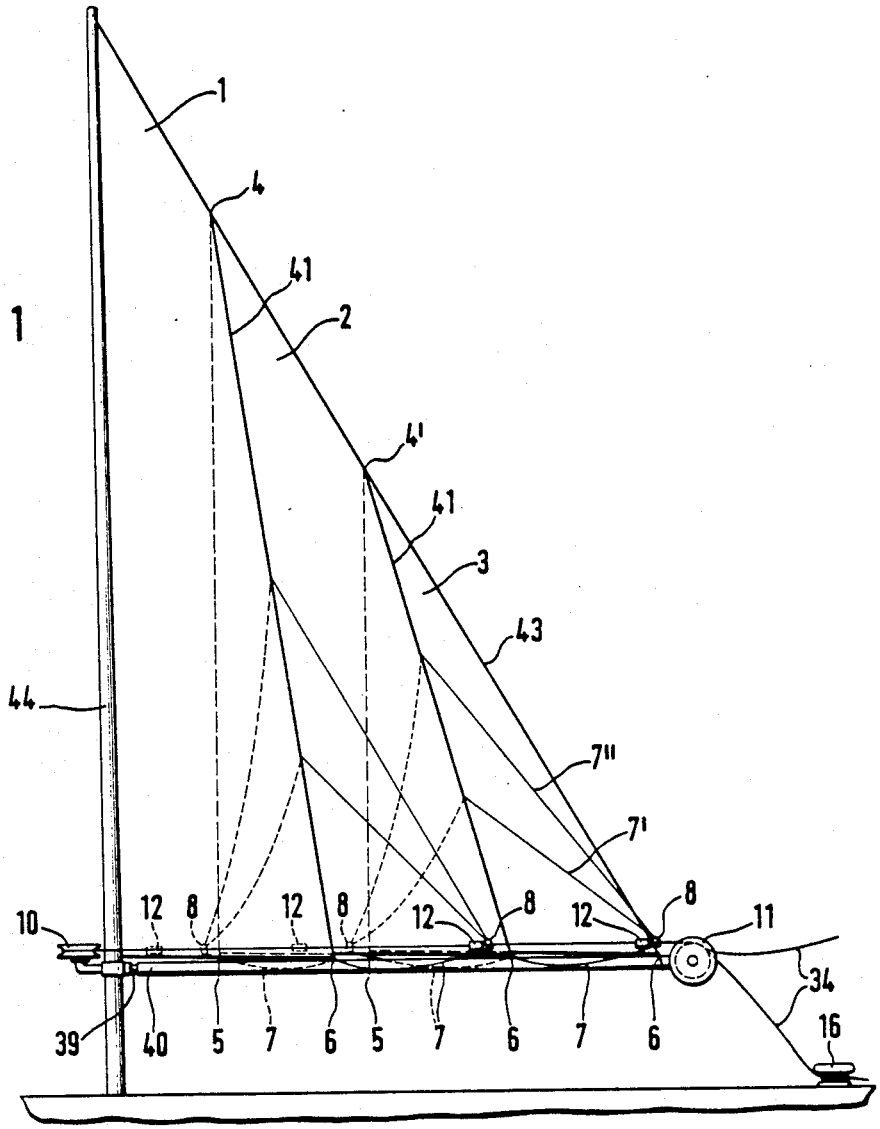
FIG. 1 is a schematic side view of a boat main sail with mast and spar boom.
Figure 3:
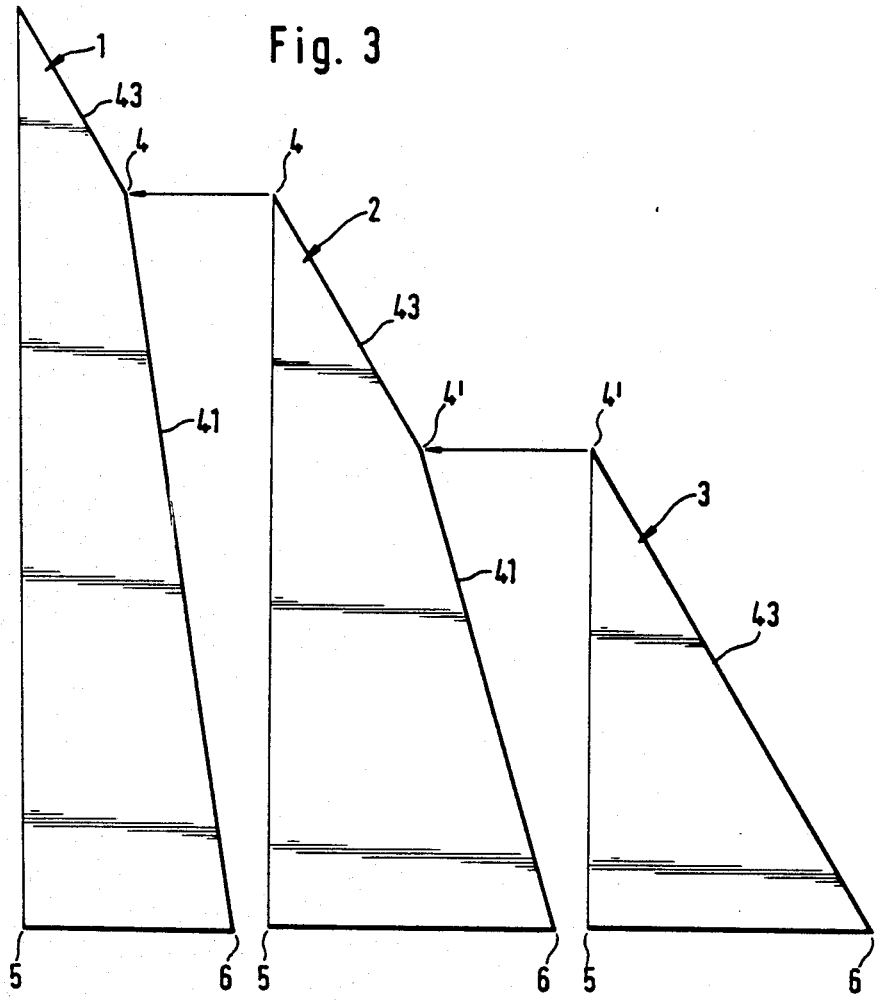
FIG. 3 is a schematic side view of the three individual profiles of the boat main sail according to the present invention.
Figure 4:
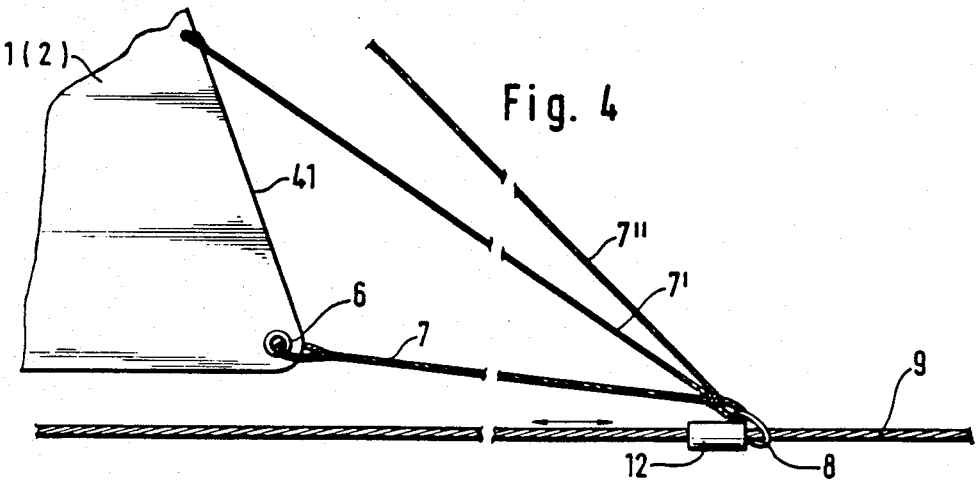
FIG. 4 is a schematic detailed view of a sheet clew with the running of the sheets.

In accordance with the present invention there is provided a sailing provision where the foresail and/or the main sail are provided as a multiprofile sail with several overlapping individual profiles variable in their distance from each other. The distance of the profiles from each other can be from about 0.9 to 4 times the maximum horizontal width of a sail profile and preferably 1.1 times the maximum horizontal width of the sail profile to about 2 times the maximum horizontal width of the sail profile and depends on the particular shape of the sail profiles. The multiplication factor is smaller for essentially triangular sail faces as shown in FIGS. 1 and 3, for example, and is larger for sail faces which have a trapezoidal shape with two substantially vertical edges. The vertical height of the profiles can be from about 3 to 6 times the widest horizontal extension. A preferred number of profiles employed on each boom is from two to about four.

The individual profiles can be pulled windward or leeward independently of the overall sail position with ropes 7 disposed at the stern side. The ropes 7 can be provided with rings 8 and the rings 8 can be guided slidably in a surrounding rope 9. The stops 12 for the sheets of the foresail or of the main sail are incorporated into the surrounding rope 9. The stops can pull and trim the individual profiles as desired to the two sides astern via freely sliding rings 8. As shown in detail in FIG. 10, parts of the sheets can be of elastic material of limited extension 13 (FIGS. 6 through 9) such that the profiles can open depending on the load and based on the wind pressure. The luff of the individual profiles of the sail can be trimmed with rope steering lines 15, 15' (FIG. 13) disposed at the bow side. These lines 15, 15' can be automatically tightened with the stops 12 and the rings 8 upon actuation by a counter motion of the surrounding rope 9 on the opposite side. The trimming provisions of the luff of the sail on the lee side can engage a point behind the luff of the sail at the sail batten in order to trim the individual profile. The sail battens can be of differing elasticity along their length. The maximum point of the elasticity can be the hinge point of the trimmer of the luff of the sail. The sheet of the foresail and of the main sail can be combined to a single rope 36 (FIG. 6) in order to allow simultaneous trimming of the profiles of the foresail and of the main sail.

The sheets can be released by a safety provision 16 depending on the heeling position in case of a danger of capsizing. This heeling dependent capsizing prevention provision can comprise hinges held together with ring compression springs, where a rope 34 (FIGS. 11 and 12), which can be for example the main sheet, is released upon opening of the hinge. The two halves of the hinge can be pressed apart by the short arm of a pendulum upon heeling of the boat to any side. The pendulum can be kept in constant vertical position with a pendulum weight. The release angle can be set separately for the two sides with set screws 24 and pressure plate disks 25, which can be adjusted in their distance to the short arm of the pendulum. The securing rope 34 can be fixed again in starting position behind the hinge after release of the hinge by a reset spring in case of decreasing wind pressure.

Figure 15:
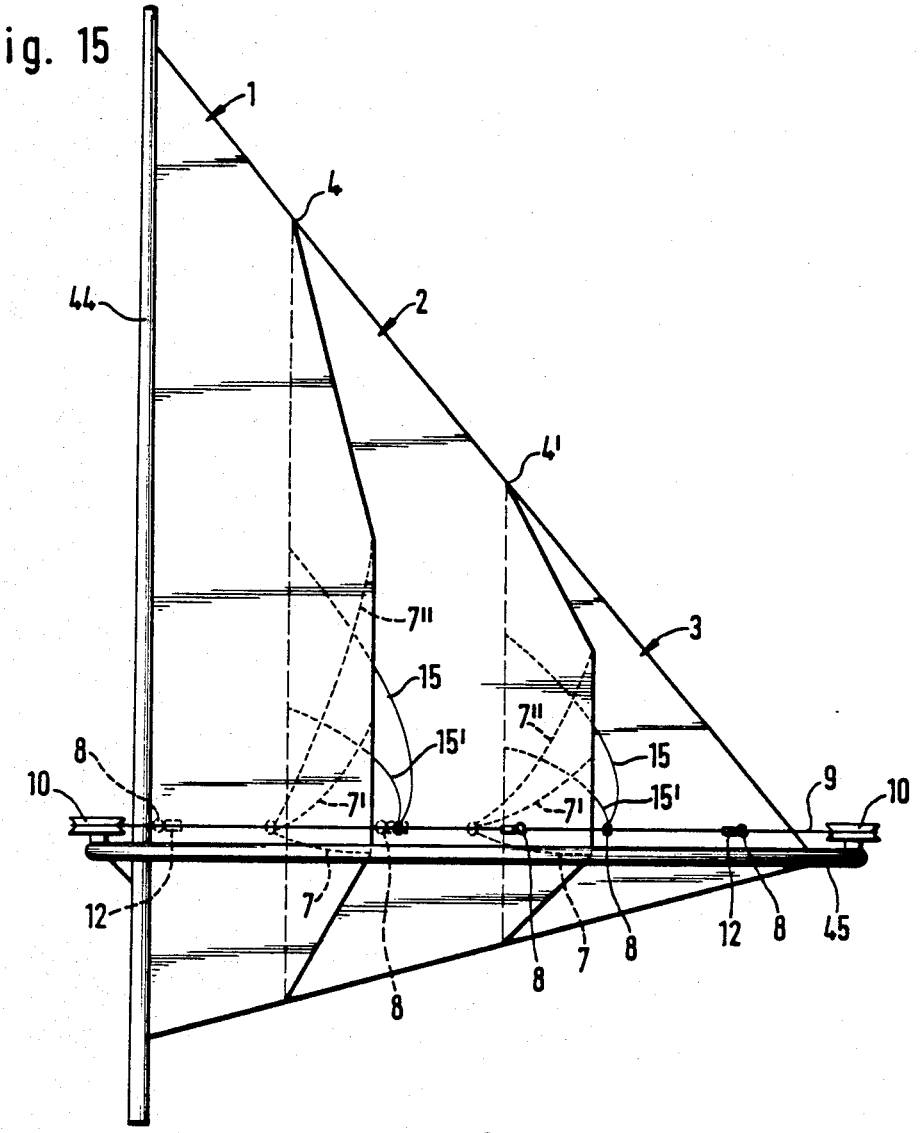
FIG. 15 is a schematic view similar to that of FIG. 13, however where only the loose ropes are shown.
Figure 16:
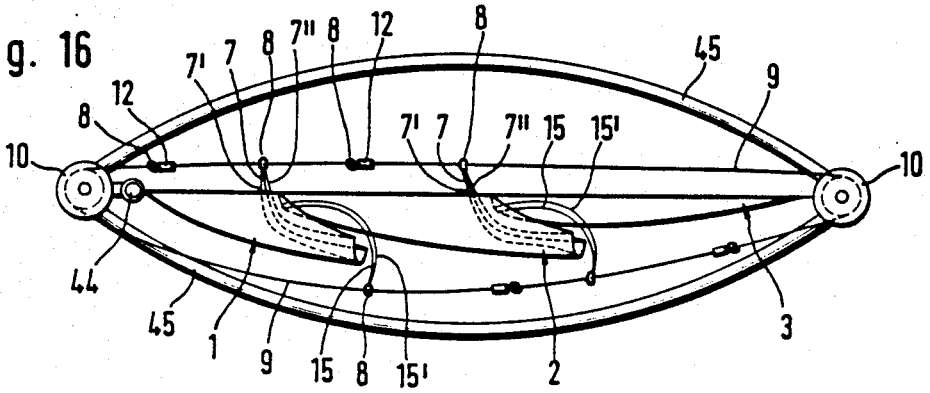
FIG. 16 is a schematic view from above of the surf sailboat of FIG. 15.
Figure 17:
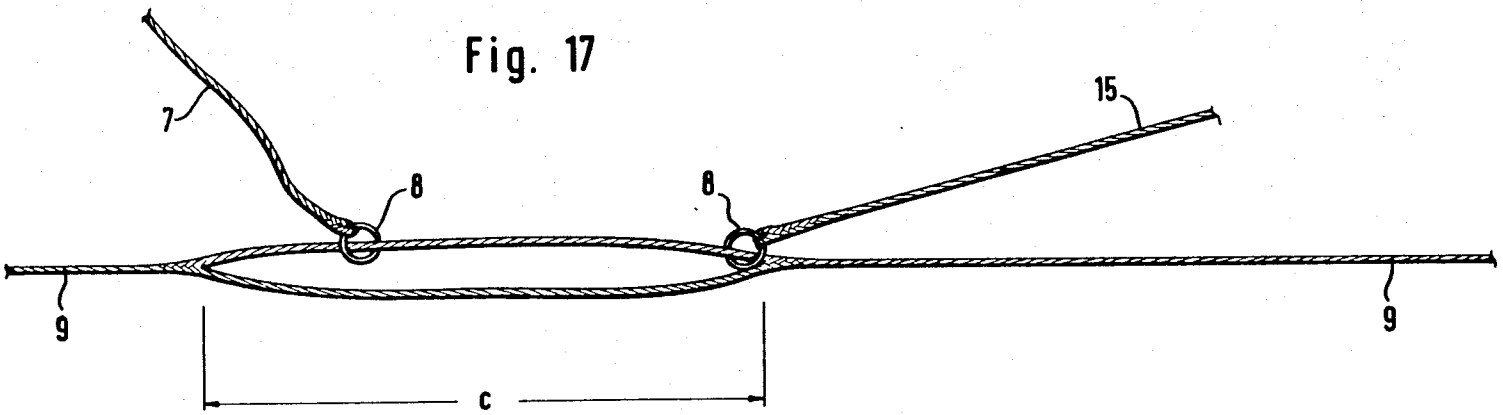
FIG. 17 is a view of a section of the surrounding rope when employed as a luff tightener.
Figure 18:
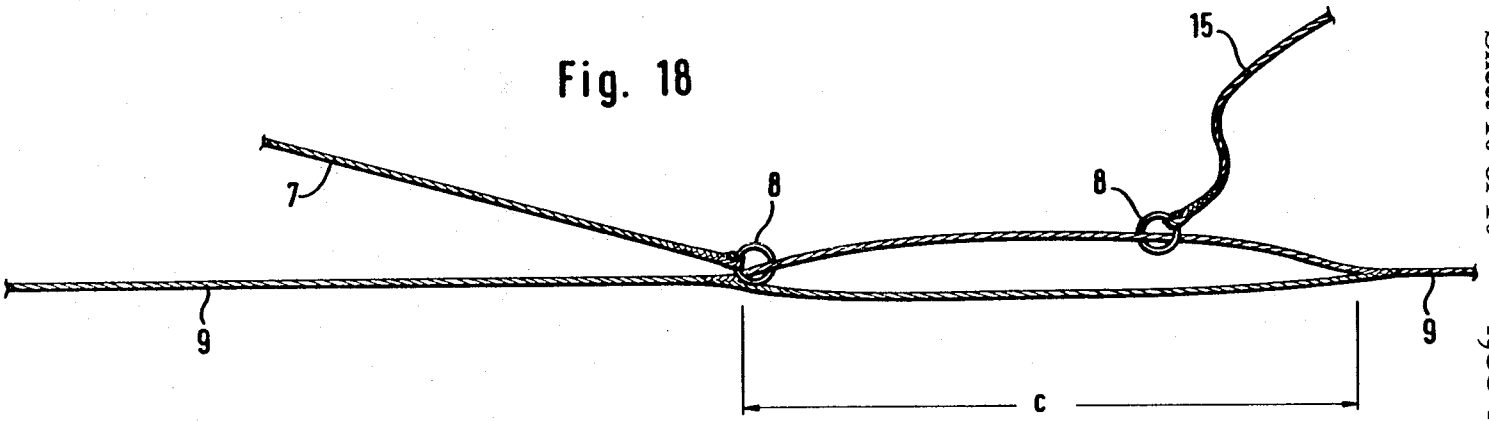
FIG. 18 is a view of the rope section of FIG. 17 when employed for tightening an after leech of a sail.

The stops for the rings incorporated into the sheet lines shown in FIGS. 1, 2, 4–9, 13–16 can be functionally substituted by providing that the rope is a dual rope over a section c (FIGS. 17 and 18).

Figure 2:
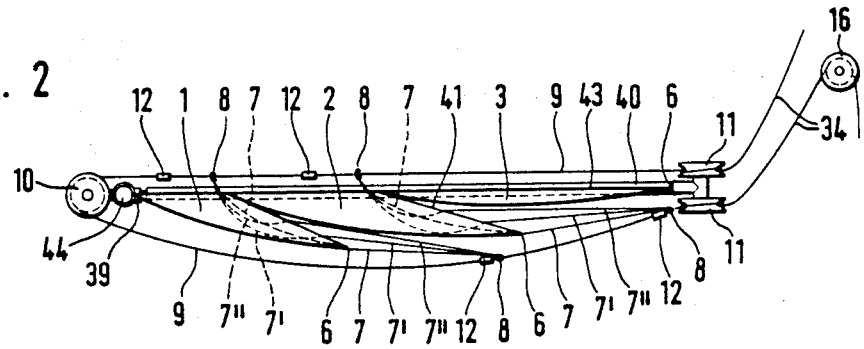
FIG. 2 is a schematic plan view looking down on the boat main sail of FIG. 1.

Referring now to FIGS. 1 and 2 there is shown a boat main sail with mast and spar boom. The sail comprises three individual profiles 1, 2, 3. Profiles 1 and 2 have an upper leech 43 and an after leech 41. The profiles can have quadrilateral shape with a substantially right angle disposed at the corner closest to the junction of mast and boom. The neighboring angles relative to the right angle of the quadrilateral profile can be acute angles and the angle opposite to the right angle can be an obtuse angle. The acute angle near the mast is preferably an angle of from about 20 to 45 degrees. The profile 3 disposed remote from the mast is preferably triangular with a substantially right angle present at the corner of the triangle located most closely to the junction of mast and boom. Profile 3 has only the upper leech 43.

FIG. 3 shows the respective form of the three individual profiles 1, 2, 3. The individual profiles are hinged at the profile connection points 4, 4' (FIG. 1) at the head of a sail and 5 (FIG. 1) at the foot of a sail. As is shown in detail in FIG. 4, the steering lines 7, 7', 7'' engage the sheet clew 6 and the after leech 41 of the profiles 1 and 2 of the sail. The steering lines 7, 7', 7'' are attached at the rings 8, through which a surrounding rope 9 runs. This surrounding rope 9 is guided by the roller 10 at the mast 44 and via the two rollers 11 at the end of the boom 40. This rope 9 also represents the main sheet in the examples of FIGS. 1 and 2. If the main sheet is tensioned from one side, then the rings 8 on the same side are pulled backward via the incorporated stops 12 and thereby the sheet clew 6 and the after leech 41 of the individual profiles of the sail are strongly tightened. The block stops 12 sliding simultaneously forward on the opposite side release the rings 8 and steering lines 7 on the opposite side and are guided loosely around the luff of the following profiles. FIG. 5 illustrates this in detail for the individual sail profile 2. The sail profiles 1 and 3 and their rigging are not shown in FIG. 5 in order to provide a clearer view. Thus the surrounding rope 9 allows to move the after leech of an individual profile to either side of the vessel.

The sailing provision described according to the present embodiment (FIGS. 1 and 2) provides the additional advantage that instead of a single main sail several sail profiles are simultaneously disposed properly according to the air flow relative to the wind.

Figure 6:
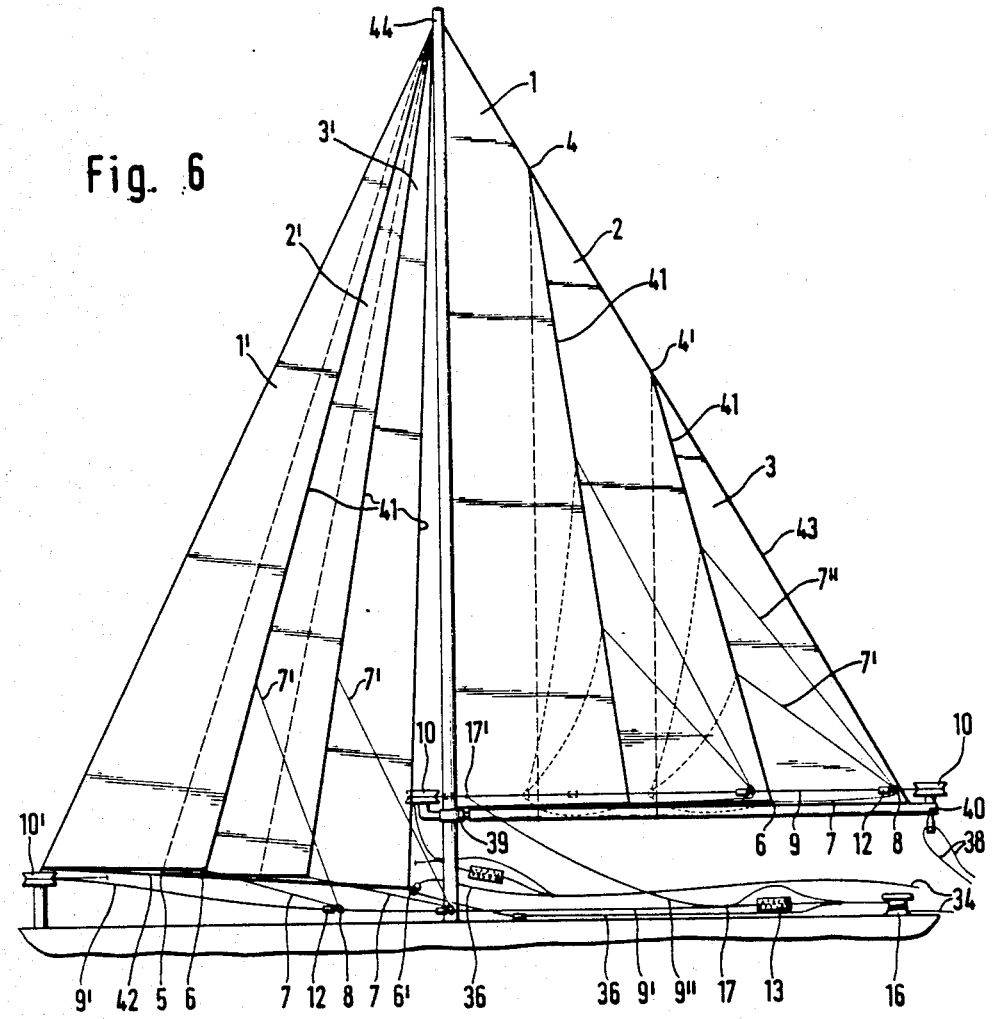
FIG. 6 is a schematic side view of a boat main sail similar to that of FIG. 1 however employing a continuous rope and a head sail.
Figure 7:
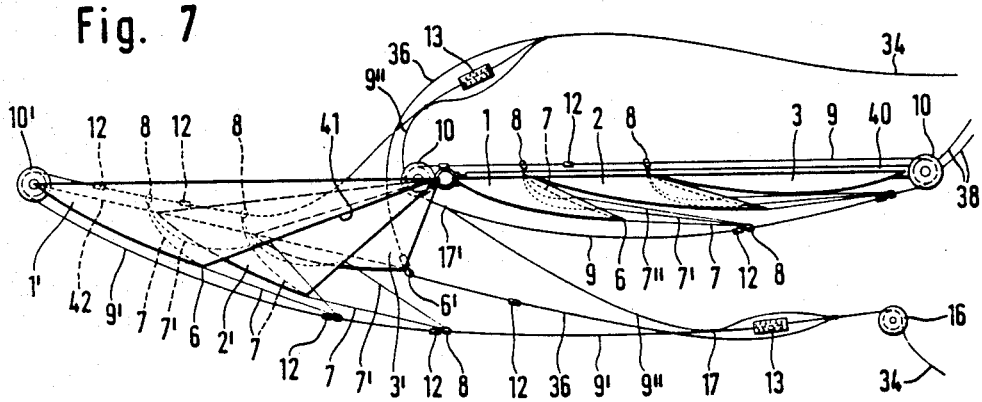
FIG. 7 is a schematic view from above of the boat of FIG. 3.

Another advantageous embodiment of the disclosed sail provision is shown in FIGS. 6 and 7. In the previous embodiment the surrounding rope was employed as main sheet, now the surrounding rope is guided as a continuous rope by two rollers 10. The simultaneous use of several foresail profiles 1', 2', 3' is shown in FIGS. 6 and 7 according to the same principle. As an embodiment, the luff of the sail of the individual profiles is guided now via a joint prolapsus support provision. The sheet of the foresail runs around a roller 10', where at the same time the first sail profile is attached and tightens the steering lines 7 via the stops 12 and the rings 8 and thereby tightens the profiles of the afterleeches 41 of the sail. The sheet of the foresail parts at the level of the mast: One rope engages the sheet clew 6' of the last foresail profile and tightens the full multiple foresail over the joint foot 42 of the sail according to the air flow pattern. The second rope 9' of the sheet of the foresail serves the profiles of the foresail via the front roller 10. A third line 9'' serves the profiles of the main sail via the surrounding rope 9 and is connected to the surrounding rope 9 at the point 17' and to the second rope 9' and to the boat main sheet rope 36 at point 17. According to this embodiment the boom 40 of the main sail has to be slackened in its own main sheet line rope 9. A restraining means 38 is provided for the main sail boom 40, which is disposed at the mast via a rack 39. The restraining means 38 can be provided by a rope.

Figure 8:
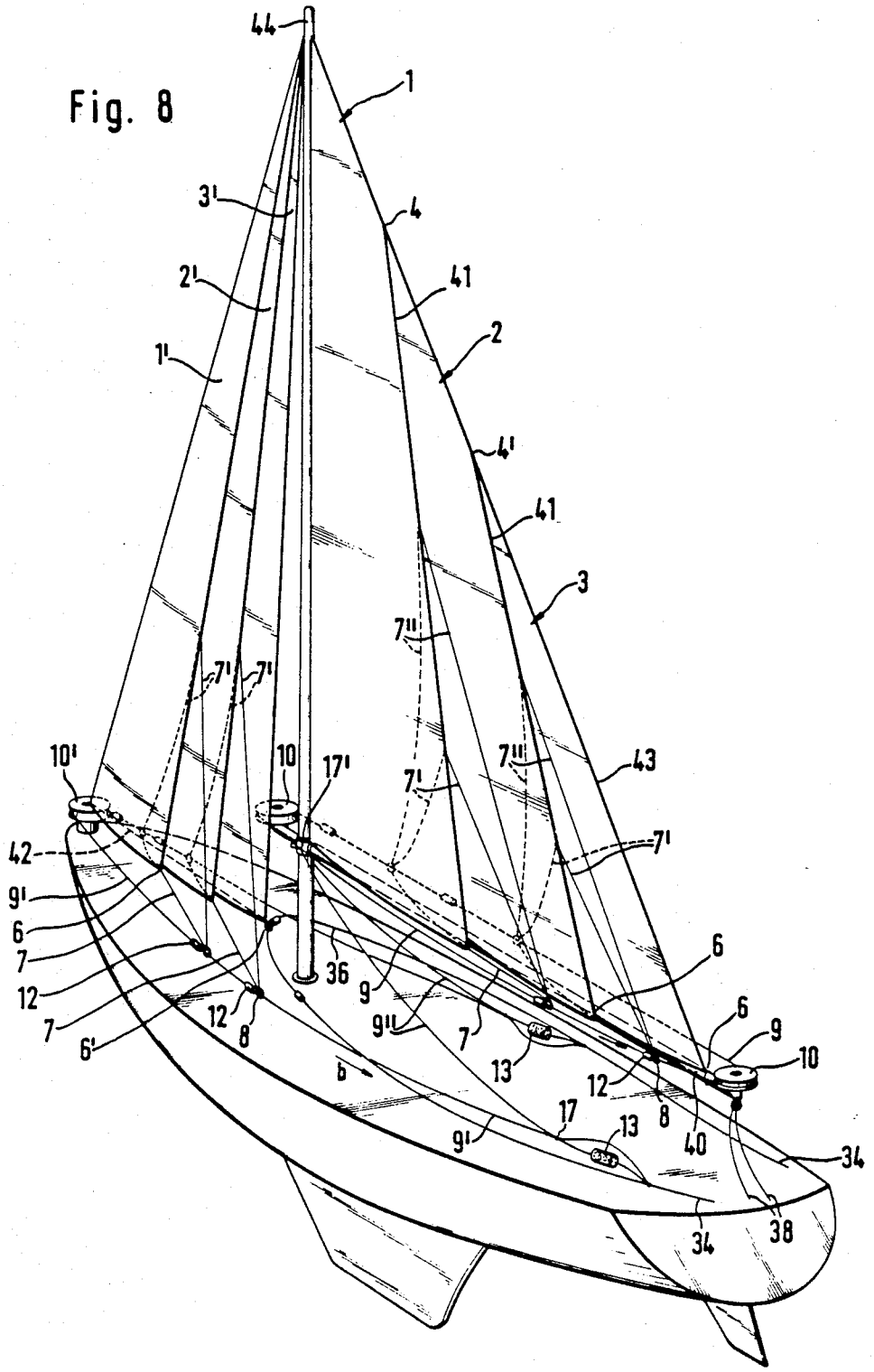
FIG. 8 is a schematic perspective view from behind of the boat of FIGS. 6 and 7 with stiffly held sheets and showing in addition the hull.
Figure 9:
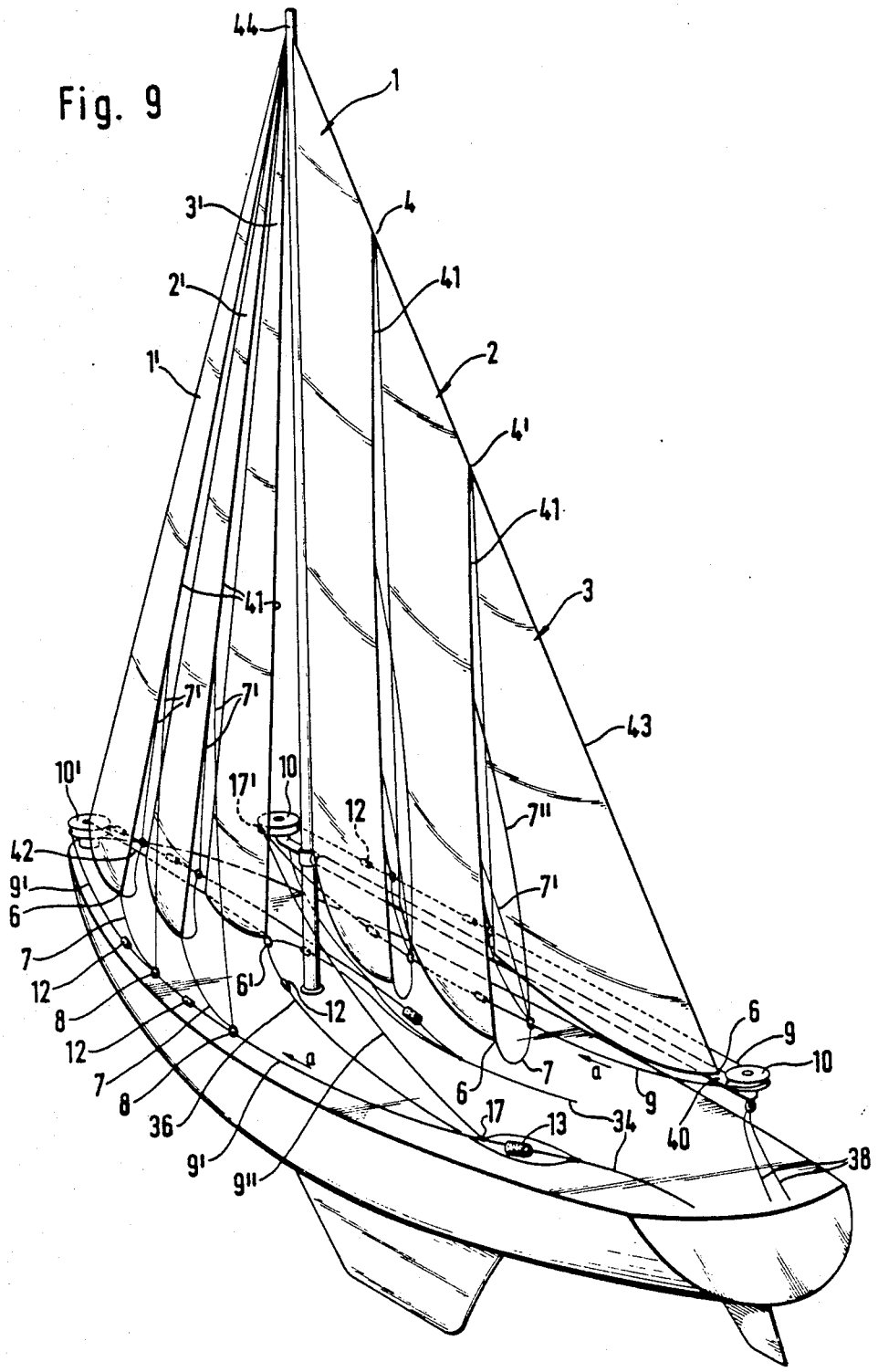
FIG. 9 is similar view to that of FIG. 8, however showing a boat with eased off sheets.

FIG. 8 illustrates the embodiment of FIGS. 6 and 7 in the case where the steering lines 7, 7', 7'' are held taut. FIG. 9 provides a similar view to that of FIG. 8 but in FIG. 9 the steering lines are eased off.

The arrangement of FIGS. 6–9, which looks possibly complicated on paper, can however be operated with ease in practical situations and does result not only in a superb efficiency relative to the thrust of the sails, but results additionally in a suprising speed in turning maneuvers. Despite the multiple profiles, the possibility of a reefing of the sails remains open in case it is needed. This can be accomplished via the luff of the foresail or via the head of the sail in case of the main sail. The surrounding rope 9 can be shortened for reefing of the foresail by placing another turn around the roll 10' corresponding to the shortening of the foot of the sail of the first profile of the foresail. The provision results in a simple safety provision against capsizing at the same time if section parts 13 of the rope construction 9 are made of elastic material where the elasticity is dimensioned such that the individual profiles open and close again depending on the load from a certain wind pressure without requiring the general sailing position to be changed. Such an elastic intermediate section part 13 of the rope 9 is illustrated in detail in FIG. 10. A rope is forked into two parallel sections. A first section contains a spring which elastically holds the rope of this section together. This is accomplished by placing the spring between two plates which are each attached to a rope disposed on an opposite side of the spring allowing the spring to pull the two ropes together. When the rope is being held together the first section is shorter than a second parallel section. Since the individual profiles can be turned rapidly due to the very short path length in contrast to a total foresail or a total main sail, the hinge point of which is represented by the luff of the sail or by the mast, such a capsizing safety device responds quickly and provides a high degree of safety to the complete construction.

Figure 12:
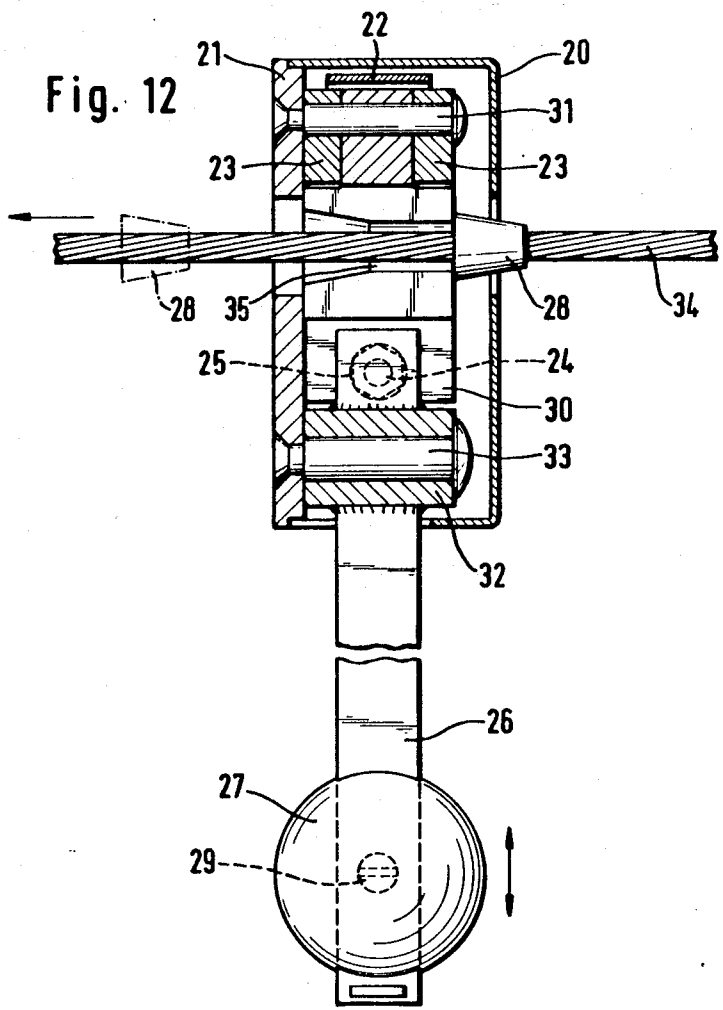
FIG. 12 is a cross-sectional view of the safety provision of FIG. 11 looking along the line XII—XII of FIG. 11.
Figure 11:
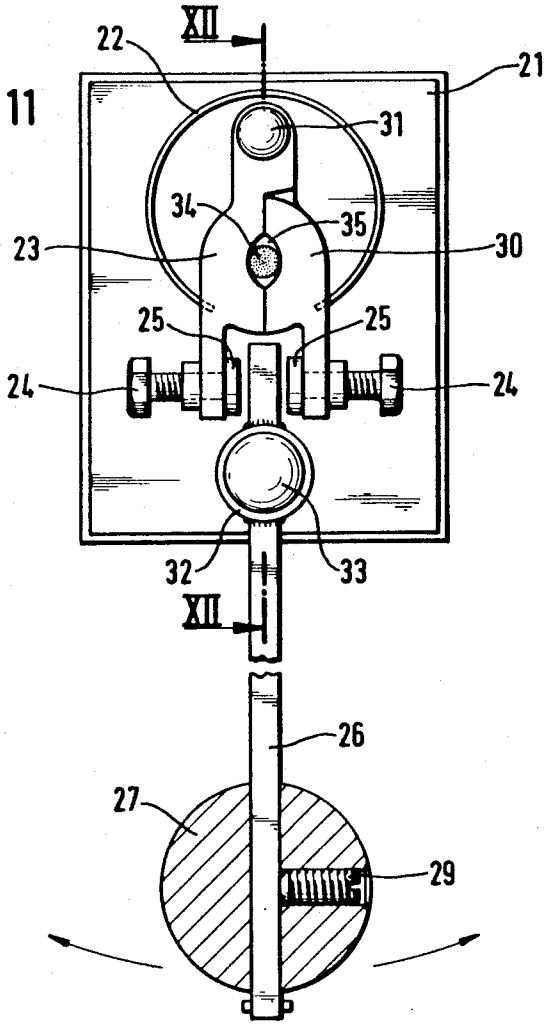
FIG. 11 is a cross-sectional view, perpendicular to the hinge axis, of a hinge release safety provision against heeling.

An embodiment of the heeling dependent capsizing prevention provision is schematically shown in FIGS. 11 and 12. The release force or torque is adjustable and an automatic resetting with decreasing wind pressure is provided. A hinge is rotatably disposed under a cover 20 on a base plate 21 via a bolt 31 and the two arms 23, 30 of the hinge are pressed together via the compression spring 22. The rope 34 with the stop nipple 28 (FIG. 12) runs through an eye formed by the two halves of the hinge. The pendulum rod 26 with the adjustable pendulum weight 27 is also rotatably disposed on the base plate 21 via bolt 33 in the bushing 32. The pendulum weight 27 is adjustable by an adjustment screw 29. If the boat starts heeling, then the constantly vertical pendulum maintained in position by gravity turns versus the heeling boat and presses apart the two hinge arms 23, 30 and releases the stop nipple 28. Rotary plate disks 25 are disposed on the inner sides of the two half parts of the hinge, which are adjusted with locked set screws 24 in the direction of the pendulum rod 26. Thus the release force can be adjusted depending on the heeling angle. In addition, this capsizing prevention provision provides the advantage that it is effective relative to the two sides in case of unexpected sailing maneuvers.

If the boat has risen up again under decreasing wind pressure, then the rope 34 is again pulled into its starting position behind the hinge due to a reset spring. The conical formation of the stop nipple 28 (FIG. 12), a sufficient amount of lubricant as well as a corresponding construction of the compression spring 22 allow the two half parts of the hinge to be easily separated in case of an automatic return of the sheet line. The angle of the cone relative to the axis of the cone can be from about 10 to 20 degrees. A combination of the heeling dependent capsizing prevention provision of FIGS. 11 and 12 and the wind pressure dependent capsizing provision via the elastic sheet line intermediate piece 13 (FIGS. 6–10) results in a soft response which is appropriate to sailing, of the rigging and tackling in case of corresponding danger situations by providing a complete positioning "into the wind" of the individual profiles in an extreme case.

Figure 13:
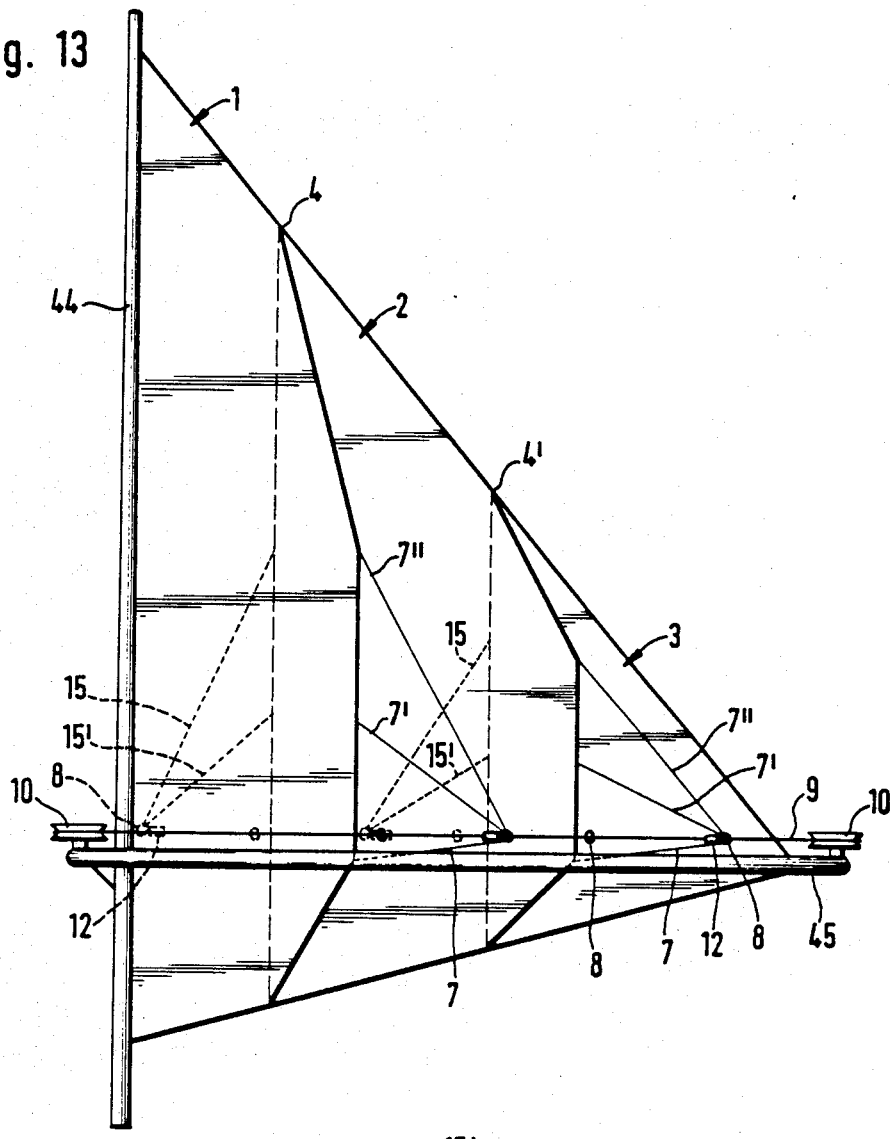
FIG. 13 is a schematic side view of the multiple profile sail for surf sailboats with only the taut ropes shown.
Figure 14:
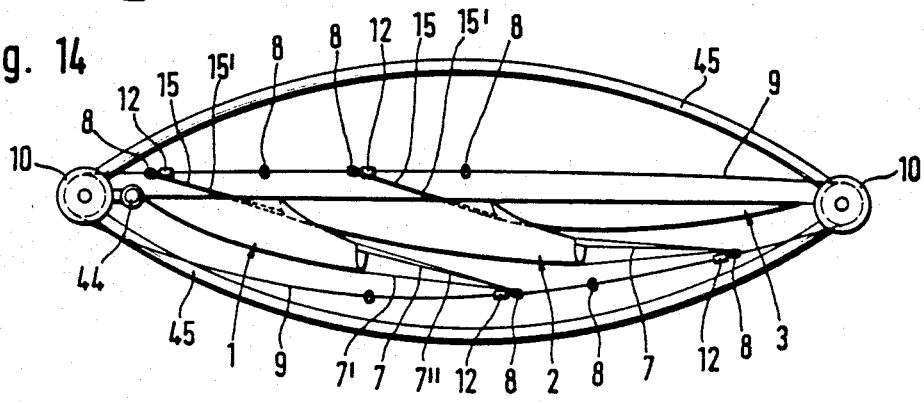
FIG. 14 is a schematic view looking down onto the surf sailboat of FIG. 13.

An advantageous embodiment of the multi-profile sail is demonstrated in FIGS. 13–16 for surfboards. Since in the case of a surf sail the foot of the sail is not provided with its guide in its own forked boom 45, the profiles are spanned via their own additional steering lines 15, 15' attached to the luff of the individual profiles 2 and 3 and guided by rings 8' which in turn are pulled forward on the windward side via the block stops 12' of the surrounding rope 9, which occurs automatically on the windward side and on the lee side based on the motion in directions of opposite sense. Thereby it is assured that the luffs of the individual profiles are tightened taut and favorable for the air flow. FIGS. 13 and 14 illustrate the case where the respective rope lines 7, 7', 7'' and 15, 15' are taut. FIGS. 15 and 16 show the case when the ropes are eased off.

The provision on the surfboard is operated simply by having the sailor, who stands on the windward side, pull the surrounding rope 9 forward and hold fast to it at the cross-beams at the same time or fix it in a Curry clamp. The sailor then releases it with a short jolt during turning or veering in order to tension it again on the opposite side in a counter direction and to fix it in position. Experiments have shown in this case that the handling is sufficiently uncomplicated to be operated during the very rapid sailing maneuvers on a surfboard. The tensioning provision steering lines 15, 15' for the luffs of the sail profiles are in addition very much suited for forming a pronounced wing-like profile in case of single sails, if the steering lines 15, 15' are linked simultaneously at the sail batten on the lee side of the sailing profiles immediately behind the luff of the sail profile, in particular if this batten is relatively elastic in its front part region, with a maximum of elasticity at the linking point and with increasing rigidity astern.

In particular, in the area of the surrounding rope 9 it is a technical advantage in sailing to substitute the stops 12 of the rope 9 as shown in FIGS. 1, 2, 4 to 9 by a loop with two arms as is shown in FIGS. 17 and 18, where the ring 8 slides in the manner of a slider clutch in order to tension the steering lines 7, 7', 7'' of one profile or the steering trim lines 15, 15' of the following profile. According to the invention the rope 9 is changed in its position by a distance c which is identical with the length of the loop. In the position of FIG. 17 it serves as a tightener for the luff of a sail, and in the position of FIG. 18 it tightens the after leech of a sail.

FIGS. 8 and 9 illustrate further purposes of the invention. The sail in FIG. 1 comprises the individual profiles 1, 2, 3. The individual profile 1 runs from the top of the mast or a point close thereto via the link point 4, the sheet corner 6 (left occurrence), the link point 39 of the boom 40 at the mast and is delineated by the mast itself. The part of this profile disposed at the mast, that is, its front edge, is continuously linked to the mast as this is conventional in nearly all sailboats. This feature is well known to a person skilled in the art, and such attachment can be provided for example by a groove in the mast which guides the front profile. The following individual profile is then bordered by the following parts: hinge part 4, hinge point 4', sheet corner 6 (middle occurrence), link point 5 at the foot leech, and from there via the dashed line back to the point 4.

The individual profile 3 is limited by the link point 4', the sheet corner 6 (right occurrence), the link point 5' and from there via the dashed line to the point 4'. It can be recognized that the individual profiles 1 and 2 have a quadrilateral shape and that the individual profile 3 has a triangular shape. The top leech is the connection of the tip of the mast or a point slightly lower to the sheet corner 6 disposed at the end of the boom. Usually the top leech is provided as a steel rope to which the sail is attached with its upper edge. This means that the upper edges of the individual profiles 1, 2, 3 are preferably attached to a steel rope. Upon a tilting out of the sail, the boom necessarily follows the tilting because the sheet corner is fixed as a so-called free end at the end of the mast. According to the present invention, the sheet corner 6 is also to be designated as a free end of the sail or, respectively, of the individual profile in each case. The sheet corner tilts by itself away from the boom. There is one exception. The last profile as can be recognized from FIGS. 8 and 9, is fixedly attached at the boom 40 at its rear end. The link points 5 are the fixed points attached at the boom 40. In each case, a foot leech runs from the fixed link points 5 to the sheet corner 6. The individual profile 1 is represented in FIG. 2 by a straight and a curved line. The straight line is identical with the rear part of the individual profile 1 of FIG. 1, which runs from the link point 4 to the sheet corner 6 (left occurrence). This also designated as afterleech. The curved line represents the lower part of the tilted out individual profile 1, that is, the foot leech, and has the end points link point 39 to the recited sheet corner 6.

Upon a tilting of the individual profiles 1 and 2, the front edge (luff) of the profile 2 enters into a non-interfering interaction with the rear edge (afterleech) of the profile 1. This is made possible by the rings 8 which can be actuated via the steering line and which are in mutual interaction with the stops 12. They cause a pulling forward of the lower parts of the afterleeches in each case and thus a sliding past of the afterleeches at the luffs coordinated to them in each case, respectively, of the individual profile disposed behind in a moving direction. For example, the afterleech of the individual profile 1 is pulled far enough forward that it can slide by or tilt by at the luff of the individual profile 2. The base form of the profile 2 as well as that of profile 1 corresponds to the interaction of profile 2 and profile 3 where the front part is in the same way provided with a luff as was described with the two profiles 1 and 2. Only the afterleech of the profile 3, as was set forth above, is fixed at its two ends with the boom. Thus it moves back and forth over the boom upon change of wind direction.

The steering lines 7, 7', 7'' are at one of their ends in each case attached to rings. On the other ends, they are either linked to a sheet corner 6 or at two points of the afterleech 7', 7''.

The ropes shown with dashed lines or, respectively, steering ropes are in particular as follows. Rope 9 is an endless rope which runs on the two rollers 10 and which slides through the corresponding rings. The steering lines 7, 7' and 7'' are solidly attached at the said rings. The rings at their ends are solidly hinged at a respective sheet corner 6. If now the rope 9, as shown in FIG. 9, moves in a direction parallel to a, then the stops shown with dashed line move further from the rings 8, that is, on the lee side. On the other hand, stops 12, disposed on the windward side and dashed in the drawing, are disposed like a mirror image. These stops 12 move toward the rings 8 coordinated to them until they are stopped and thereby take the rings 8 with them. This can also be recognized in FIG. 7. Thereby the rings 8 are moved opposite to the direction a and also carry with them the steering ropes 7 solidly connected to the ring 8. This moves the individual profile 1, 2 corresponding in each case both forwardly as well as in the direction of the previous windward side, that is, the afterleech 41 of the for example individual profile 1 is pulled past the luff of the profile 2 and is tilted to what was up to now the windward side. However, since during such a maneuver, at the same time the direction of motion of the boat changes and the wind now comes from the other side, the wind pressure additionally effects a sliding by ahead of the luff disposed in each case immediately behind. The same holds for the further individual profiles, where the profiles 1', 2', 3' associated with the head sail are engaged via the rope 9' acting as a head sheet. In general, this rope 9' is not provided as an endless rope as is the rope 9. For this reason, it automatically takes the rope 9 with it via the two hinge connection points 17, 17'.

Thus as the steering ropes 7 are moved, thereby also move the steering ropes 7' and 7'', which, on the one side are solidly connected to mentioned rings 8, and on the other side are attached to the afterleeches. During the maneuver, the steering lines thus release the afterleeches 41 in order to allow an improved or, respectively, easier tilting at the luffs of the profiles disposed behind. On the other hand, in the respective end position reached after the maneuver, they effect a tensioning of the recited leeches.

The ropes 9' and 9'' are solidly connected to each other as illustrated in FIG. 7 in the region of the elastic sheet intermediate pieces. If the wind pressure becomes too strong, for example, on the profiles of the head sail, then this pressure is transmitted via the rope 9' or, respectively, the rope 9'' onto the elastic sheet intermediate piece 13. This elastic intermediate sheet piece 13 become stretched, since the rope 34 disposed behind the part 13 in the rope direction is lashed and clamped via a winch 16 illustrated only in FIGS. 3 and 4. Thus the rope 34 cannot give because it is fixed.

This stretching of the intermediate piece 13 results in a partial or complete release of the rings 8, which up to now had been held by the stops 12, thus increasing the deflection of the individual profiles.

If the wind pressure becomes even stronger, the individual profiles can flap open completely via the release of the rope 34 by the automatic safety means against capsizing (not shown in the drawings now under consideration), which means was described in FIGS. 11 and 12 and which could be placed for example at the position of the winch 16. Thus the boat can straighten itself and the automatic safety provision against capsizing can switch back to its starting position.

Simultaneously, the rope 9'' acting as a main sheet is linked at the surrounding rope 9 as can be recognized in FIG. 8. The rope 9'' meets the rope 9' slightly ahead of the elastic intermediate piece 13 at the hinge connection point 17. Thus is effected a compounding of the three ropes 9, 9' 9'', to which the loose end (rope 34) of the rigging also belongs.

Thus it is only required that the rope 34 be actuated in order also to actuate all further ropes 9, 9' and 9'' and thus the full rigging. In addition, the rope 34 can also be connected to the rope 38 which actuates the boom and thus full control is united in a single hand.

An interference of neighboring individual profiles as described in the state of the art in the Lowry reference cannot occur according to the present invention. Furthermore, it is possible to perform the sailing maneuvers not only more rapidly than in this known arrangement, but also more quickly than with other known sailing boats.

The sailing means described, in particular with the capsizing safety device, is associated with the further advantage that it can make do with conventional materials, in contrast to the case with rigid sails, and that the relatively simple construction allows refurbishing of boats without large expenditures.

It will be understood that each of the elements described above, or two or more together, may also find a useful application in other types of sail system configurations and sail boat construction procedures differing from the types described above.

While the invention has been illustrated and described as embodied in the context of a sailing provision including a capsizing prevention feature, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

I claim:

1. A sailing means comprising a vessel;

a multiprofile sail including a plurality of individual profiles for wind interaction, which profiles are disposed sequentially relative to a forward direction of the vessel, and which profiles overlap each other as seen in a side projection of the vessel such that the rear end of a profile overlaps with the front end of a following profile and which individual profiles can be varied in their angle formed with the forward direction and thereby the profiles are variable in their distance as measured in a direction perpendicular to the plane of respective profiles from each other;

linking ropes linked to the individual profiles near a lower outer side point of the profile and disposed toward the stern side of the vessel, where the linking of individual profiles is independent of the overall angular position of the sails formed by the profiles; and a surrounding rope running about along the sides of the vessel and connected to the linking ropes wherein by activation of the surrounding ropes the sequentially disposed profiles can be jointly adjusted.

2. The sailing means as set forth in claim 1 wherein the individual profiles can be pulled collectively windward or leeward with ropes disposed on the stern side and where the pulling is independent of a sequential position of an individual profile of the sails.

3. The sailing means as set forth in claim 1 further comprising rings provided near a first end of ropes connected near a second end of ropes to the profiles, wherein said first end of ropes is disposed on the ropes substantially opposite to the second end of the ropes and where the surrounding rope runs through the rings and where the rings are movable and guided freely slidable over the surrounding rope.

4. The sailing means as set forth in claim 3 wherein stops for interacting with a sheet line of the sail are attached to the surrounding rope and where the stops can pull or trim the individual profiles astern to both sides as desired via free sliding rings.

5. The sailing means as set forth in claim 4 wherein parts of the sheets are provided of an elastic material of limited extension such that the profiles can yield elastically to wind forces based on the wind pressure and depending on the load.

6. The sailing means as set forth in claim 4 wherein the luff of the individual profiles can be trimmed with ropes disposed at the bow side usually in the front of the vessel and where such ropes can interact with said stops.

7. The sailing means as set forth in claim 4 wherein the ropes can be automatically tightened based on the stops and the rings upon actuation of a main sheet line of the sail by a counter motion of the surrounding rope on the opposite side of the vessel, wherein said counter motion is in a direction opposite relative to a direction of motion of automatically tightening based on the stops and the rings.

8. The sailing means as set forth in claim 4 wherein a trimming means of the luff of the sail engages leeward at a point behind the luff of the sail at a sail batten in order to trim the individual profile.

9. The sailing means as set forth in claim 8 wherein the sail battens are of differing elasticity along their length.

10. The sailing means as set forth in claim 9 wherein the maximum of elasticity is located at a connecting hinge point of the trimming means of the luff of the sail.

11. The sailing means as set forth in claim 4 wherein the sheet lines of a headsail and a main sail are combined to a joint rope in order to allow trimming of the profiles of the headsail and the main sail at the same time.

12. The sailing means as set forth in claim 1 further comprising a front roller for redirecting the surrounding rope, where two ropes provided for each individual profile with one rope connected to a first branch side of the surrounding rope and with a second one rope connected to a second branch side of the surrounding rope such that pulling on one side of the surrounding rope results in a trimming of the ropes associated with that side and is accompanied by a loosening of the ropes associated with the other side.

13. The sailing means as set forth in claim 12 further comprising two rollers disposed astern each for rolling up a respective end of the surrounding rope and thereby controlling the positioning of the profiles.

14. The sailing means as set forth in claim 12 wherein the surrounding rope forms an endless loop; and further comprising a rear roller supporting the endless loop of surrounding rope at the rear side.

15. A sailing means comprising a vessel;

a plurality of individual profiles forming a multiprofile sail, where the individual profiles overlap each other as seen in a side projection such that the rear end of a profile overlaps with the front end of a following profile and wherein the individual profiles can be turned by an angle and are thereby variable in their relative distance to each other as measured in a direction perpendicular to a plane of respective profiles;

linking ropes connected to a lower end of a sailing profile and disposed toward the stern side of the vessel a linking of individual profiles is independent of the overall angular position of the sails formed by the profiles;

a surrounding rope running about the outside of the vessel and connected to the linking ropes;

a heeling angle dependent securing provision mounted to a sheet line for releasing the sheet line in case of a danger of capsizing which securing provision comprises a hinge held together based on a ring pressure spring and the hinge being capable of opening upon a capsizing motion, where the sheet line is led through the hinge, which sheet line is released upon opening of the hinge for preventing capsizing.

16. The sailing means as set forth in claim 15 wherein the sheet line of a main sail runs through the hinge and further comprising a pendulum having a short and a long arm, where the two halves of the hinge are pressed apart by the short arm of a pendulum upon heeling of the boat to any side and where the pendulum is kept in a constant vertical position by a pendulum weight.

17. The sailing means as set forth in claim 16 further comprising set screws and cover plates, which can be manually adjusted in their distance to the short arm of the pendulum such that the release angle can be separately adjusted for the two sides.

18. The sailing means as set forth in claim 15 wherein the securing rope after release by the hinge can be fixed again behind the hinge in starting position based on a reset spring upon decrease of the wind pressure.

19. The sailing means as set forth in claim 16 wherein the rings are guided freely slidable along a certain length over one part of a two part rope section of the rope.

20. A method to sail a vessel comprising employing a sail constructed as a multiple profile sail with individual profiles overlapping each other as seen in a side projection such that the rear end of a profile overlaps with the front end of a following profile, which profiles can be varied in their relative distance to each other as measured in a direction perpendicular to a plane of respective profiles;

pulling windward or leeward the individual profiles independently of the total sail position with respective stern located ropes;

guiding the stern located ropes with rings attached to their ends, which rings slide freely a certain distance over a surrounding rope serving as a joint pulling line for at least two profiles; and jointly adjusting the profiles as sequentially disposed by activation of the surrounding rope; releasing a rope in case of a danger of capsizing dependent on a heeling angle.

21. The method to sail a vessel according to claim 20 further comprising pulling and trimming as desired astern the individual profiles to a selected side via the freely sliding rings attached to the profiles and limited incorporated into the surrounding rope, the sheet line of the headsail and the sheet line of the main sail.

22. The method to sail a vessel according to claim 20 further comprising allowing the opening of the profiles depending on the load based on the wind pressure by employing parts of the sheet lines made of elastic material of limited extension.

23. The method to sail a vessel according to claim 20 further comprising securing the vessel against capsizing by running a sheet line through a hinge kept closed with a ring compression spring; and releasing the sheet line by opening of the hinge.

24. The method to sail a vessel according to claim 23 further comprising maintaining a pendulum mounted on the vessel in a vertical position with a pendulum weight;

separating the two halves of the hinge with the short arm of the pendulum upon heeling of the vessel to any side;

setting the release angle of the vessel with regard to overturning for a desired side with set screws and pressure plates to be contacted by the short arm of the pendulum, which pressure plates can be adjusted in their relative position to the short arm of the pendulum.

* * * * *